US009320408B2

(12) United States Patent
Hansen et al.

(10) Patent No.: US 9,320,408 B2
(45) Date of Patent: Apr. 26, 2016

(54) CLEANING PAD AND STEAM APPLIANCE

(71) Applicant: BISSELL Homecare, Inc., Grand Rapids, MI (US)

(72) Inventors: Eric J. Hansen, Grand Rapids, MI (US); Kevin Haley, Grand Rapids, MI (US); Jay M. Kellis, Grand Rapids, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 199 days.

(21) Appl. No.: 14/021,519

(22) Filed: Sep. 9, 2013

(65) Prior Publication Data

US 2014/0076368 A1 Mar. 20, 2014

Related U.S. Application Data

(60) Provisional application No. 61/701,940, filed on Sep. 17, 2012.

(51) Int. Cl.
*A47L 13/22* (2006.01)
*A47L 13/16* (2006.01)

(52) U.S. Cl.
CPC ..... *A47L 13/225* (2013.01); *A47L 13/16* (2013.01)

(58) Field of Classification Search
None
See application file for complete search history.

(56) References Cited

U.S. PATENT DOCUMENTS

| | | | | |
|---|---|---|---|---|
| 5,991,970 | A * | 11/1999 | Jailor et al. | 15/339 |
| 6,101,661 | A | 8/2000 | Policicchio et al. | |
| 6,584,990 | B2 | 7/2003 | Shaw | |
| 6,601,261 | B1 | 8/2003 | Holt et al. | |
| 6,766,552 | B1 | 7/2004 | Policicchio et al. | |
| 7,144,173 | B2 | 12/2006 | Policicchio et al. | |
| 7,891,047 | B2 * | 2/2011 | Milanese | 15/320 |
| 8,187,240 | B2 | 5/2012 | Busam et al. | |
| 8,458,850 | B2 | 6/2013 | Kasper et al. | |
| 2005/0229344 | A1 * | 10/2005 | Mittelstaedt et al. | 15/104.94 |
| 2008/0166176 | A1 | 7/2008 | Rees et al. | |
| 2011/0145191 | A1 | 6/2011 | Anderson et al. | |
| 2011/0232578 | A1 | 9/2011 | Duke et al. | |

(Continued)

FOREIGN PATENT DOCUMENTS

| | | | |
|---|---|---|---|
| CA | 2284654 | A1 | 1/1998 |
| CA | 2266783 | | 1/2004 |
| CN | 2436093 | Y | 6/2001 |

(Continued)

OTHER PUBLICATIONS

Bissell Steam Mop™ Deluxe Model 31N1 User's Guide, 12 pages, dated 2010.

(Continued)

*Primary Examiner* — Michael Barr
*Assistant Examiner* — Cristi Tate-Sims
(74) *Attorney, Agent, or Firm* — McGarry Bair PC

(57) ABSTRACT

A surface cleaning apparatus has a steam distribution manifold located along the leading edge of a foot assembly and configured to apply steam to a surface to be cleaned, in front of the cleaning pad. The cleaning pad trailing the manifold can absorb soil, stains and residual moisture from the cleaning process as the steam appliance is moved across the surface to be cleaned. The cleaning pad can comprise a superabsorbent material. In another embodiment, the cleaning pad can comprise a melamine foam with abrasive particles interspersed therein and configured to agitate the surface to be cleaned in conjunction with steam.

16 Claims, 8 Drawing Sheets

(56) References Cited

U.S. PATENT DOCUMENTS

| | | | | |
|---|---|---|---|---|
| 2012/0042462 | A1* | 2/2012 | Milanese et al. | 15/104.93 |
| 2012/0216832 | A1 | 8/2012 | Pung et al. | |

FOREIGN PATENT DOCUMENTS

| | | | |
|---|---|---|---|
| CN | 2482956 | Y | 3/2002 |
| CN | 201996475 | U | 10/2011 |
| EP | 1857035 | A1 | 11/2007 |
| WO | 2009148911 | A1 | 12/2009 |
| WO | 2011019814 | A2 | 2/2011 |

OTHER PUBLICATIONS

Jay M. Kellis, Surface Cleaning Apparatus, U.S. Appl. No. 13/836,630, filed Mar. 15, 2013, Acknowledgement Receipt, Specification, and Figures—26 pages.

Adam Luedke, Surface Cleaning Apparatus, U.S. Appl. No. 13/788,957, filed Mar. 7, 2013, Acknowledgement Receipt, Specification, and Figures—79 pages.

Claus Blumenberg, European Search Report, 5 pages, Oct. 15, 2015, Munich.

* cited by examiner

CLEANING PAD AND STEAM APPLIANCE

CROSS-REFERENCE TO RELATED APPLICATION

This application claims the benefit of U.S. Provisional Patent Application No. 61/701,940, filed Sep. 17, 2012, which is incorporated herein by reference in its entirety.

BACKGROUND OF THE INVENTION

Steam appliances, such as steam mops, with or without vacuum, and handheld steamers are configured for cleaning a wide variety of common household surfaces such as bare flooring, including tile, hardwood, laminate, vinyl, and linoleum, as well as countertops, stove tops and the like. Typically, steam mops comprise at least one liquid tank or reservoir for storing water or other treating liquid that is fluidly connected to a selectively engageable pump or valve. The outlet of the pump or valve is fluidly connected to a steam generator, which comprises a heating element for heating the liquid. The steam generator produces steam, which can be applied directly or indirectly to the surface to be cleaned. One common form of an indirect application of steam to the surface is to supply the steam through a distributor nozzle or a manifold located in a foot or cleaning head that engages the surface to be cleaned. Steam is typically applied to the backside of a cleaning pad that is attached to the cleaning head. The steam may pass through the pad to the surface. Alternatively, the steam may saturate the cleaning pad to form a heated, damp pad, which is wiped across the surface to be cleaned to remove dirt, dust, and debris present on the surface. The steam dispensed onto the cleaning surface can eventually condense into liquid on the cleaning surface. The cleaning pad is typically configured to at least partially absorb the liquid.

Additionally, auxiliary liquids such as fragrances, detergents or other additives can be supplied via the liquid tank for distribution through the surface cleaning apparatus to improve cleaning efficacy or to provide other sensory benefits. Alternatively, auxiliary liquids can be supplied from an auxiliary liquid supply tank that can be fluidly connected to the fluid delivery system, either upstream or downstream from the steam generator.

Some steam appliances locate a removable water supply tank and a steam generating device on an upright handle and deliver steam through a universal joint to a pivoting cleaning foot that is typically covered by a reusable cleaning pad. One example is the BISSELL Steam Mop™ Deluxe (Model 31N1). Details of a similar steam mop device are disclosed in Chinese Patent No. CN2482956 to Wu, issued Mar. 27, 2002. In an alternate configuration, the steam generator can be located on the cleaning head as disclosed in U.S. Pat. No. 6,584,990 to Shaw, issued Jul. 1, 2003.

A cleaning pad may be used with the steam mop. Premoistened, impregnated cleaning pads and cleaning pads that can also reabsorb liquid from a surface to be cleaned are disclosed in U.S. Pat. No. 7,144,173 to Policicchio, issued Dec. 5, 2006. A cleaning pad for a steam mop with an encapsulated composition is disclosed in U.S. application Ser. No. 13/323,286, filed Dec. 12, 2011, published as US2011/0145191, titled "Cleaning Cloth with Encapsulated Formulation, Steam Mop and Method", which is assigned to BISSELL Homecare, Inc. and incorporated herein by reference in its entirety. Cleaning pads for a steam mop can comprise a variety of materials, such as micro-fiber, terry cloth, non-woven fiber sheets and combinations thereof.

BRIEF SUMMARY OF THE INVENTION

According to one aspect of the invention, a surface cleaning apparatus includes a foot movable along a surface to be cleaned, a handle coupled to the foot for maneuvering the foot along the surface to be cleaned, a cleaning pad adjacent to a lower surface of the foot and positioned to contact the surface to be cleaned, a steam generator provided on one of the foot and the handle for producing steam, and a steam distribution manifold pivotally mounted along a front of the foot and comprising at least one steam outlet in fluid communication with the steam generator to deliver steam to the surface to be cleaned, wherein the steam distribution manifold is movable between a first position for applying steam to the surface to be cleaned and a second position in which the steam distribution manifold is raised with respect to the first position.

According to another aspect of the invention, a surface cleaning apparatus includes a foot movable along a surface to be cleaned, a handle coupled to the foot for maneuvering the foot along the surface to be cleaned, a cleaning pad adjacent to a lower surface of the foot and positioned to contact the surface to be cleaned, a steam generator provided on one of the foot and the handle for producing steam, and a steam outlet provided in the foot in fluid communication with the steam generator to deliver steam through the cleaning pad, wherein the cleaning pad comprises a melamine formaldehyde foam with abrasive particles interspersed therein.

DESCRIPTION OF EMBODIMENTS OF THE INVENTION

The invention generally relates to cleaning pads for a steam cleaning apparatus with heat, steam and cleaning composition delivery.

Figure 1:
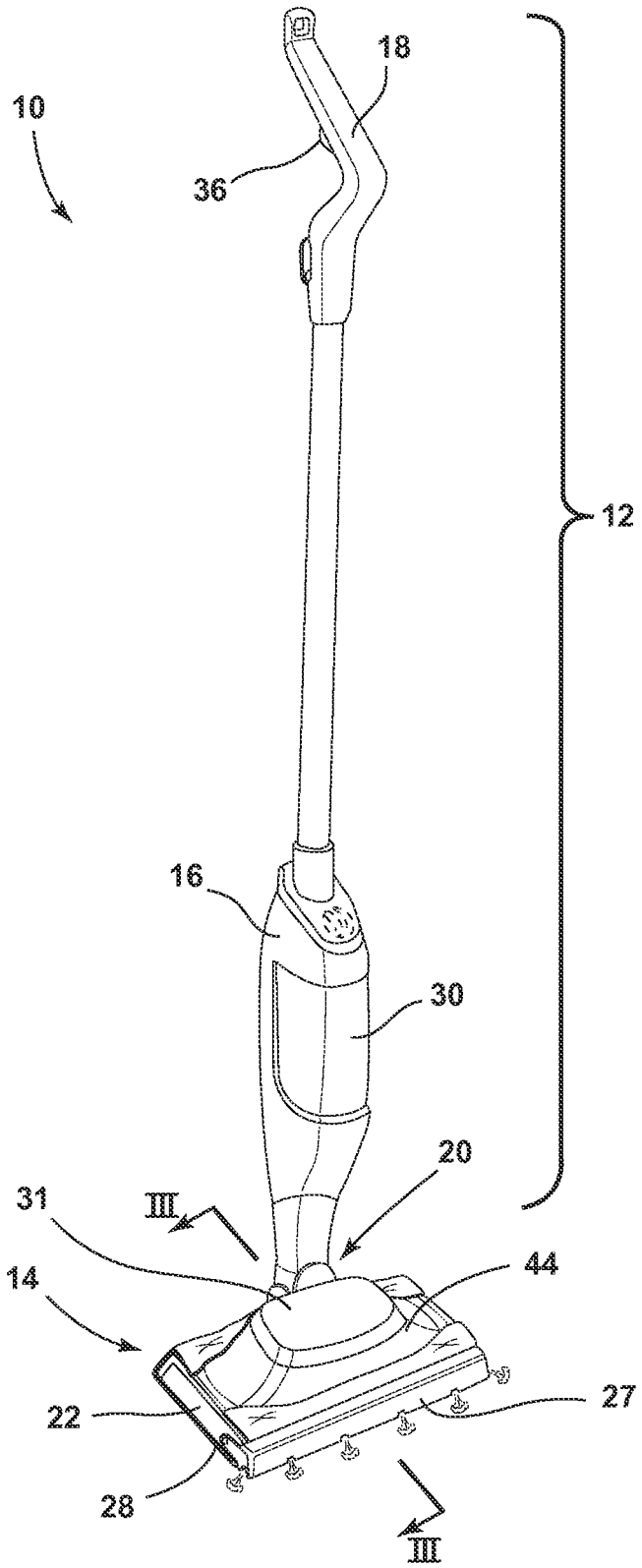
FIG. 1 is a front perspective view of a surface cleaning apparatus in the form of a steam mop according to a first embodiment of the invention.

FIG. 1 is a front perspective view of a surface cleaning apparatus in the form of a steam mop 10 according to a first embodiment of the invention. The steam mop 10 comprises an upright handle assembly 12 mounted to a cleaning foot assembly 14. The upright handle assembly 12 further comprises a handle housing 16 located between a handle grip 18 and a joint 20. The cleaning foot assembly 14 is removably attached to the joint 20 to moveably mount the foot assembly 14 to the handle assembly 12. In one embodiment, the joint 20 can comprise a universal joint 20, such that the foot assembly 14 can pivot about at least two axes relative to the handle housing 16.

Figure 3:
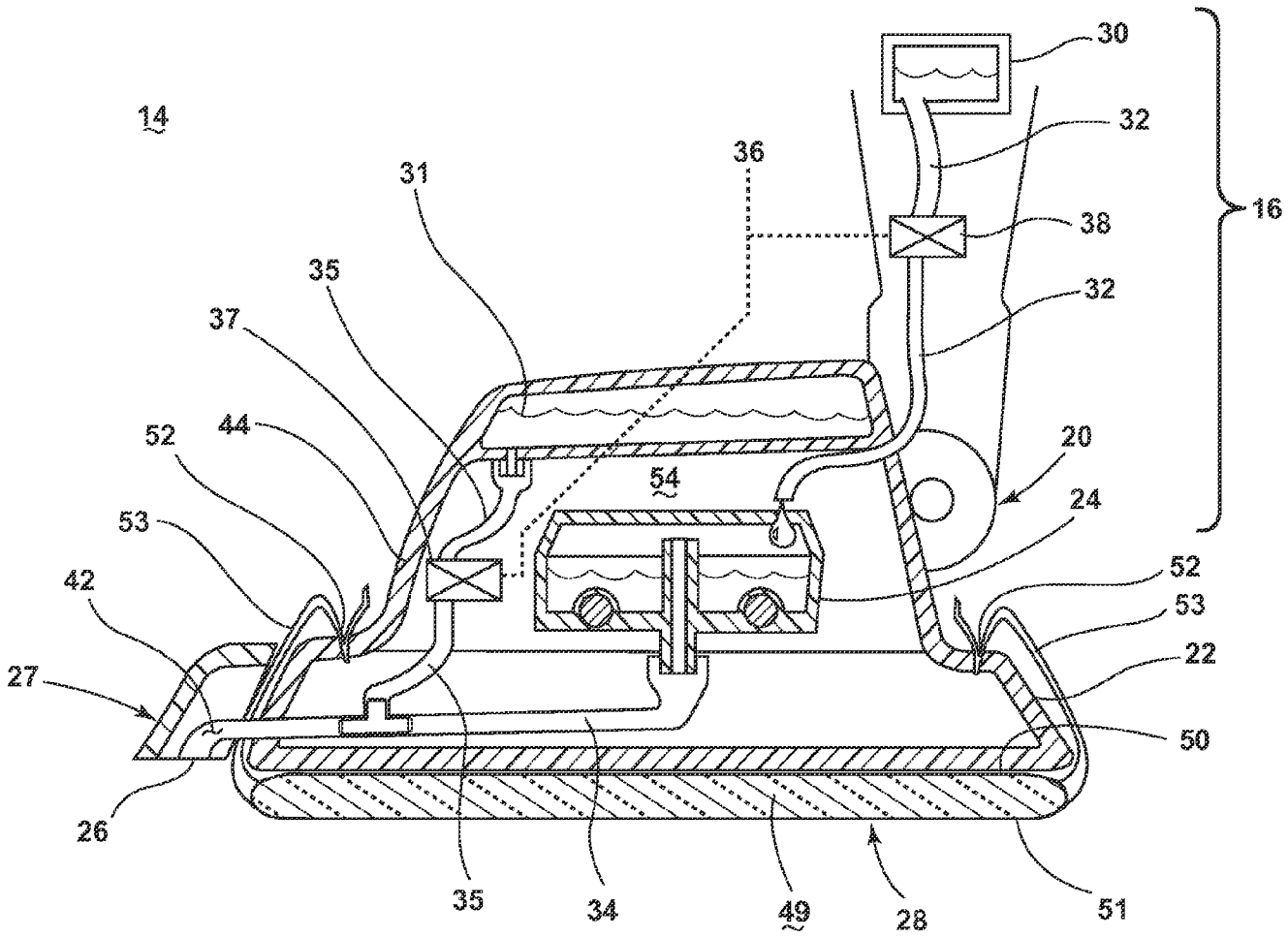
FIG. 3 is a schematic, partial cross-sectional view of the foot assembly of FIG. 1 taken along line III-III with a portion of the fluid delivery system of the steam mop shown schematically.

With reference to FIG. 3, the foot assembly 14 further comprises a steam frame 22, a steam generator 24, at least one steam outlet 26 at a bottom portion of a steam distribution manifold 27 that is pivotally mounted along the front edge of the steam frame 22. Although not shown in the figures, a steam distribution manifold can be pivotally mounted along the rear edge of the steam frame 22 in a similar manner, in addition to or instead of the front steam distribution manifold 27. Also optionally, a second steam outlet (not shown) can be provided at the bottom portion of the steam frame 22.

A cleaning pad 28 is removably attached to a lower surface of the steam frame 22. In one embodiment, the cleaning pad 28 does not substantially cover the steam distribution manifold 27, which is exposed along the front edge of the foot assembly 14.

The handle housing 16 further accommodates a portion of a fluid delivery system comprising a cleaning solution reservoir 30 that is configured to distribute cleaning solution to downstream portions of the fluid delivery system. The cleaning solution can comprise water or a mixture containing water and a composition. The fluid delivery system can further comprise an auxiliary solution reservoir 31 as more fully described in U.S. application Ser. No. 13/788,957, filed Mar. 7, 2013, titled "Surface Cleaning Apparatus", which is assigned to BISSELL Homecare, Inc., now US2013/023713, and incorporated herein by reference in its entirety. A solution conduit 32 fluidly connects the cleaning solution reservoir 30 to the steam generator 24 for conveying liquid from the reservoir 30, through the universal joint 20, and into the steam generator 24. A steam conduit 34 fluidly connects the steam generator 24 to the steam outlet 26 for conveying steam generated by the steam generator 24 through the steam distribution manifold 27 and steam outlet 26, onto the surface to be cleaned. An auxiliary solution conduit 35 can fluidly connect the auxiliary solution reservoir 31 to the steam conduit 34, downstream from the steam generator 24. An auxiliary valve 37 can be included within the auxiliary solution conduit 35 to control flow of auxiliary solution therethrough. When the valve 37 is opened, auxiliary solution can flow into the steam conduit 34 under gravity and can be carried by a steam flow exiting the steam generator 24, through the steam conduit 34 as a commingled mixture of steam and auxiliary solution, which will be referred to as "steam" herein, which is distributed through the steam distribution manifold 27 and expelled onto the surface to be cleaned through the steam outlet 26.

The steam generator 24 can comprise an in-line flash heater mounted within the foot assembly 14. Additional examples of suitable steam generators for mounting within the foot of a steam mop are more fully described in U.S. Pat. No. 6,584,990 to Shaw and U.S. application Ser. No. 13/836,630, filed Mar. 15, 2013, titled "Surface Cleaning Apparatus", assigned to BISSELL Homecare, Inc., US2013/0318725, which are both incorporated herein by reference in their entirety. Alternatively, the steam generator 24 can be mounted within the handle assembly 12.

A trigger 36 is pivotally mounted to the handle grip 18 (FIG. 1) and is accessible for selective engagement by a user. The trigger 36 is operably coupled to a valve 38 that is fluidly connected between the cleaning solution reservoir 30 and steam generator 24 for selectively controlling flow of solution through the solution conduit 32, from the cleaning solution reservoir 30 to the steam generator 24. Likewise, the trigger 36 is operably connected to the auxiliary valve 37 fluidly connected between the auxiliary reservoir 31 and the steam conduit 34 for selectively controlling flow of auxiliary solution from the auxiliary solution reservoir 31 to the steam conduit 34. In one embodiment, the trigger 36 can be connected to an upper end of a push rod (not shown) that is slidably mounted within the handle housing 16, with a bottom end of the push rod in register with the valve 38 and operably connected to the auxiliary valve 37 by a linkage (not shown). Alternatively, one or both of the valve 38 and auxiliary valve 37 can be an electrically controlled valve such as a solenoid valve, for example. The trigger 36 can have a two-way actuation, such that the valves 37, 38 can be operated independently using the same trigger 36; alternatively, actuation of the trigger 36 can operate both valves 37, 38 at the same time.

Additional examples of steam mops, steam mop pads and cleaning methods that may be used with embodiments of the invention described herein include the BISSELL Steam Mop™, sold in the United States by BISSELL Homecare, Inc. and International Application No. PCT/US10/45167, filed Aug. 11, 2010, published as WO2011/019814, titled "Upright Steam Mop with Auxiliary Hand Tool" and U.S. application Ser. No. 12/778,615, filed May 12, 2010, now U.S. Pat. No. 8,458,850, titled "Upright Steam Mop Sweeper" and U.S. application Ser. No. 13/788,957, filed Mar. 7, 2013, titled "Surface Cleaning Apparatus", published as US2013/0232713, and U.S. application Ser. No. 13/323,286, filed Dec. 12, 2011, published as US2011/0145191, titled "Cleaning Cloth with Encapsulated Formulation, Steam Mop and Method", and U.S. application Ser. No. 13/013,956, filed Jan. 26, 2011, published as US2012/042462, titled "Absorbent Pad for a Steaming Apparatus" all of which are herein incorporated by reference in their entirety.

Figure 2A:
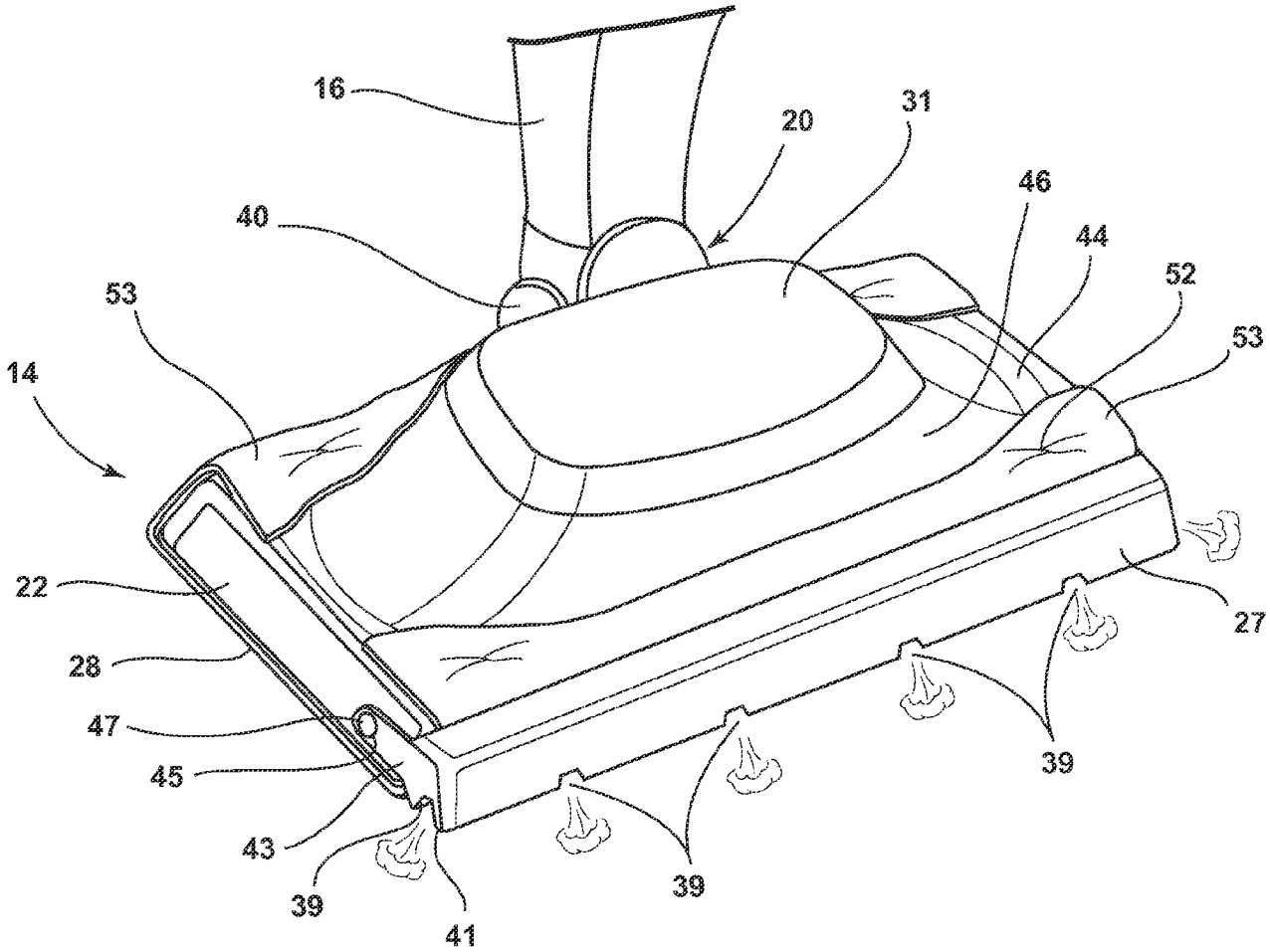
FIG. 2A is a partial perspective view of the foot assembly of the steam mop of FIG. 1, with a movable steam manifold in a down position.

FIG. 2A is a partial front perspective view of the cleaning foot assembly 14 with the cleaning pad 28 mounted to the bottom of the foot assembly 14, behind the steam distribution manifold 27. The universal joint 20 is pivotally mounted to corresponding bosses 40 on the upper rear portion of a cover 44, which is fastened to the top of the steam frame 22. The universal joint 20 is configured to rotate back and forth about a first horizontal axis that extends laterally through the sides of the steam mop 10, and from side to side about a second horizontal axis that extends from front to back, orthogonal to the first axis.

The cleaning foot assembly 14 can be interchangeable, and can be detachably mounted to the universal joint 20. The foot assembly 14 can be detached from the universal joint 20, and a substitute cleaning foot assembly (not shown) can be installed onto the joint 20 and fluidly connected to the solution conduit 32 via mating fluid fittings (not shown) in the handle housing 16 and foot assembly 14, respectively.

With reference to FIG. 2A-3, the cover 44 comprises a generally rectangular housing with a raised central portion 46, which forms a cavity 54 therein when the cover 44 is mounted to the steam frame 22 for housing the steam generator 24 therein. The cover 44 can further comprise sheet retainers 52 that are configured to hold a portion of the cleaning pad 28 in register with the foot assembly 14.

Figure 2B:
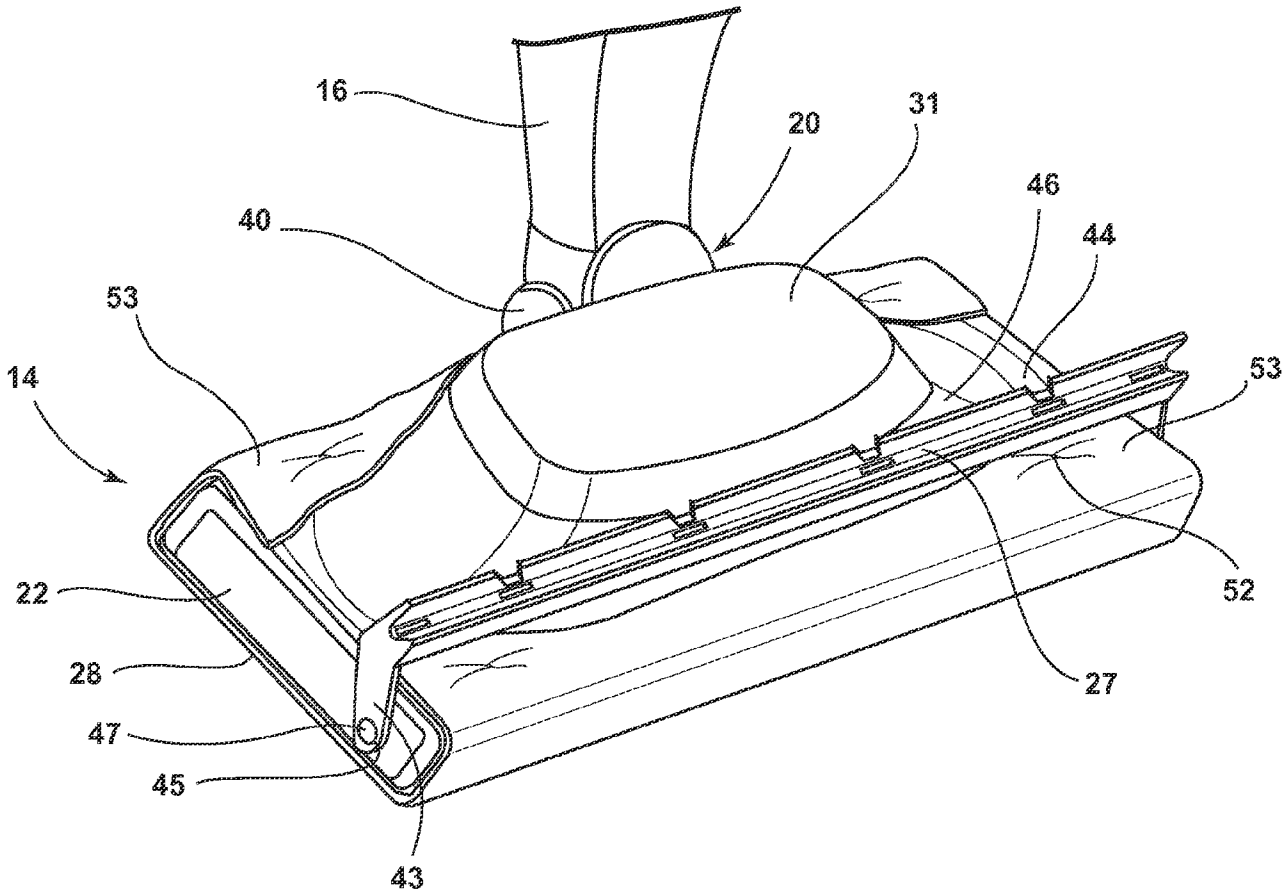
FIG. 2B is a partial perspective view of the foot assembly of the steam mop of FIG. 1, with the movable steam manifold in an up position.

The steam distribution manifold 27 comprises a hollow rectangular member with a plurality of apertures 39 through a bottom wall 41 that define the steam outlet 26. The apertures 39 are fluidly connected to the steam conduit 34 by an elongate channel 42 formed within the manifold 27. The distribution manifold 27 is pivotally mounted to the steam frame 22 by a pair of mounting arms 43 at the sides of the manifold 27. The mounting arms 43 extend rearwardly off opposed sides of the manifold 27. Each arm 43 comprises a hole 45 formed in the end thereof that provides a bearing surface for rotating about a corresponding mounting pin 47 that extends outwardly from opposed sides of the steam frame 22. The steam distribution manifold 27 is configured to selectively pivot upwardly to an "up" position, as shown in FIG. 2B, for installing or removing the cleaning pad 28 from the foot assembly 14. When the steam distribution manifold 27 is in the up position, the ends of a cleaning pad assembly 28 can be inserted into the corresponding sheet retainers 52. Also, moving the steam distribution manifold 27 to the up position exposes the front edge of the cleaning pad 28 which can be helpful when cleaning along baseboards, walls, and the like. The steam distribution manifold 27 can subsequently be rotated downwardly to a "down", in-use position, as shown in FIG. 2A, for applying steam onto the surface to be cleaned, in front of the cleaning pad assembly 28, such that the steam does not flow through or directly contact the cleaning pad 28, but instead contacts the cleaning surface directly. Detents (not shown) can be incorporated on the bearing surface between the hole 45 and the mounting pin 47 to retain the distribution manifold 27 in either of the up or down positions.

The cleaning pad 28 can comprise a variety of materials for wiping, scrubbing and agitating the surface to be cleaned as well as for absorbing and recovering soil, stains, residual cleaning composition and condensation from the surface to be cleaned so that the surface is left clean and dry after the steam cleaning operation.

In one embodiment best shown in FIG. 3, the cleaning pad 28 can comprise a superabsorbent polymer (SAP) 49 that can absorb and retain extremely large amounts of a liquid relative to its own mass. The SAP 49 can comprise any or a combination of hydrophilic cellulosic fibers such as cotton or fibrous fluff pulp, for example, and hydrogel-forming particles, such as sodium polyacrylate, for example.

The SAP 49 can have a water retention capacity of at least about 15 g/g when measured under a confining pressure of 0.3 psi. The SAP 49 can absorb about 500 times its weight when placed in deionized and distilled water, which is typically 30-60 times its own volume.

The SAP 49 can be provided in a non-woven matrix in the form of the rectangular cleaning pad 28. The pad 28 can optionally include additional layers of material, such as a top sheet 50 and or bottom sheet 51, which can comprise a thin scrim or mesh material, such as polypropylene (PP) or polyethylene terephthalate (PET) mesh cloth, for example. In one configuration, described herein for exemplary purposes, the top sheet 50 and bottom sheet 51 can be bonded together around the SAP 49. The length of the top sheet 50 and bottom sheet 51 can be longer than the SAP 49 so that flaps 53 are formed at the ends of cleaning pad 28. The flaps 53 can be inserted into the sheet retainers 52 for securing the cleaning pad 28 to the bottom of the steam frame 22. Alternatively, the top sheet 50 and bottom sheet 51 can be bonded directly to the SAP 49.

In operation, a user prepares the steam mop 10 by filling the solution reservoir 30 with cleaning liquid, which can include a chemical composition, water, or mixture thereof. The reservoir 30 can be mounted to the handle housing 16 and fluidly connected to the solution conduit 32, which fluidly connects the cleaning solution reservoir 30 to the steam generator 24 for conveying liquid from the reservoir 30 into the steam generator 24. The auxiliary solution reservoir 31 can be mounted on the foot assembly 14 and fluidly connected to the auxiliary solution conduit 35 for conveying auxiliary solution from the auxiliary solution reservoir 31 into the steam conduit 34. Upon energizing the steam mop 10, a user can selectively engage the trigger 36 to deliver liquid from the reservoir 30 to the steam generator 24, which heats the liquid passing therethrough to at least 100° C. (212° F.) to generate steam. Optionally, the trigger 36 can simultaneously actuate the auxiliary valve 37 to deliver auxiliary solution to the steam conduit 34. The steam passes through the steam conduit 34 and mixes with the auxiliary solution, which flows into the steam conduit 34 under gravity. The steam, or steam/solution mixture, flows through the steam conduit 34 to the steam distribution manifold 27 and is expelled onto the surface to be cleaned through the steam outlet 26 along the leading edge of the foot assembly 14. The steam loosens soil and removes stains from the surface to be cleaned. As the steam mop 10 is pushed across the surface to be cleaned, the SAP 49 in the cleaning pad 28 absorbs and recovers soil, stains, residual cleaning composition and condensation from the surface to be cleaned so that the surface is left clean and dry after the steam cleaning operation. The soiled cleaning pad 28 can be removed from the foot assembly 14 after the cleaning operation by pivoting the distribution manifold 27 upwardly to the "up" position and removing the flaps 53 from the sheet retainers 52. The cleaning pad 28 can then be disposed of accordingly.

Figure 4:
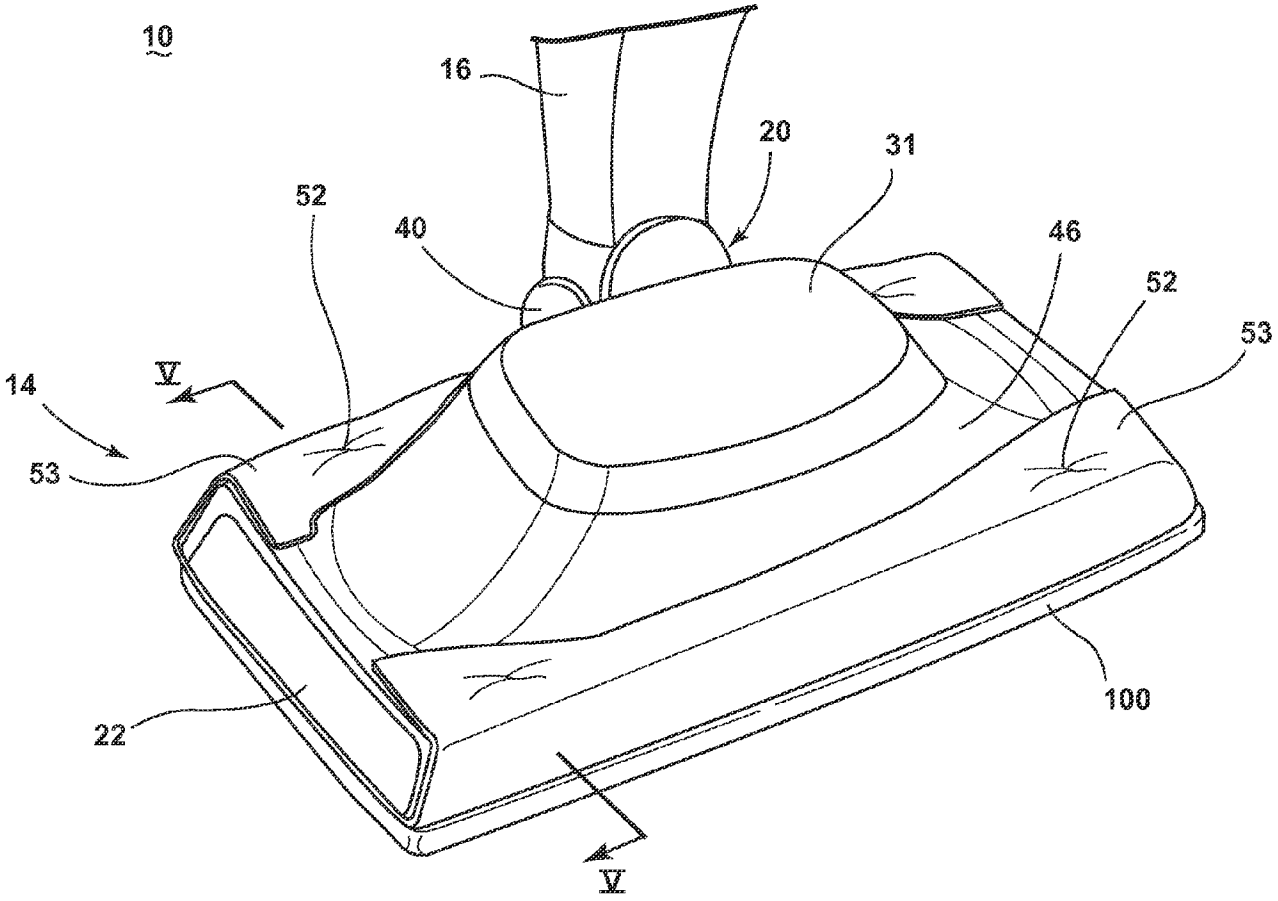
FIG. 4 is a partial perspective view of a foot assembly of a steam mop according to a second embodiment of the invention.

FIG. 4 is a partial front perspective view of a foot assembly 14 of a steam mop 10 according to a second embodiment of the invention, with a cleaning pad 100 according to a second embodiment of the invention attached thereto. In the second embodiment, like elements are referred to with the same reference numerals used in the first embodiment. The steam mop 10 of the second embodiment can be substantially the same as the first embodiment, with the exception of the location of the steam outlet 26 and aspects of the cleaning pad 100.

Figure 5:
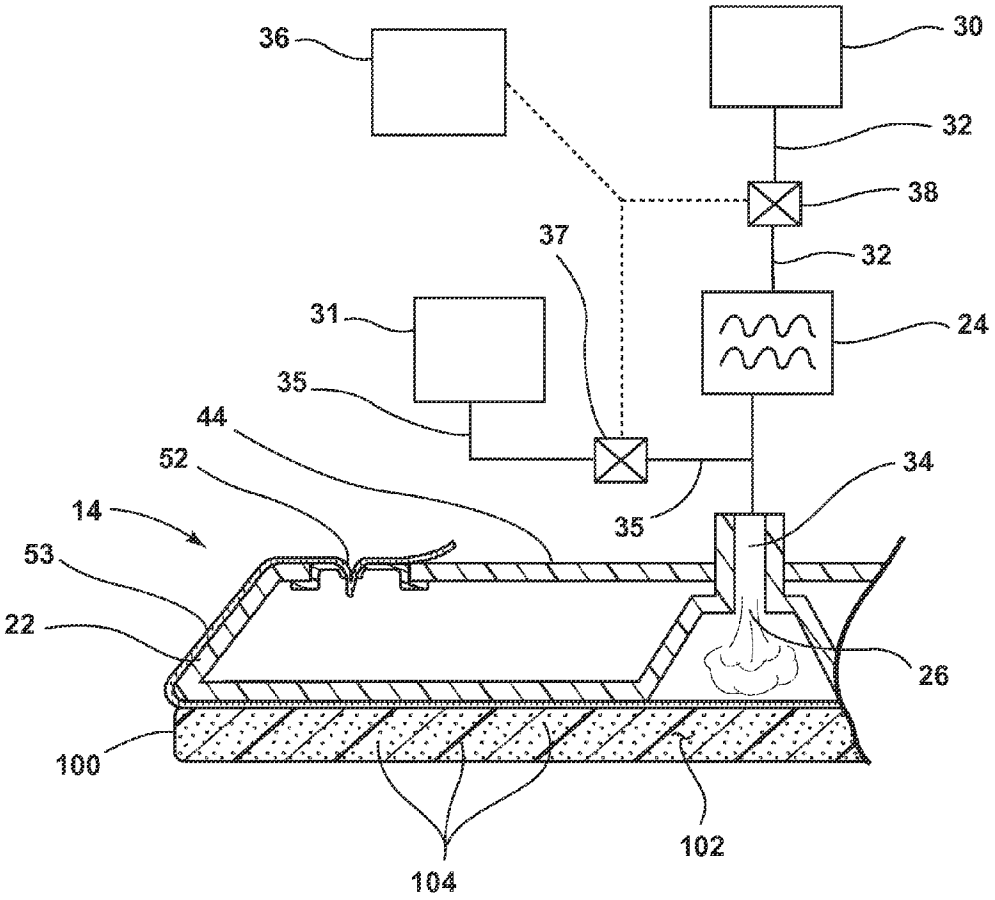
FIG. 5 is a schematic, partial cross-sectional view of the foot assembly of FIG. 4 taken along line V-V with a portion of the fluid delivery system of the steam mop shown schematically.

Referring to FIG. 5, the cleaning pad 100 can comprise a melamine formaldehyde foam 102 for agitating the surface to be cleaned in combination with steam or a steam/solution mixture applied by the steam mop 10. One such suitable melamine formaldehyde foam is Basotect®, which is commercially available from BASF Corp.

The melamine formaldehyde foam 102 can further comprise abrasive particles 104 interspersed therein for enhancing agitation of the surface to be cleaned. The abrasive particles 104 can comprise inorganic substances such as quartz, olivine, basalt, glass spheres, ceramic spheres, clay minerals, sulfates, carbonates, kieselguhr, silicates, colloidal silica or mixtures thereof, for example. Alternatively, the abrasive particles 104 can comprise organic polymers such as polyurethane, melamine-formaldehyde resin, epoxy resin, polyester, polycarbonate, polyacrylates, polyamides or mixtures thereof, for example. In one example, the average particle 104 diameters can be in a range from about 10 microns to about 1000 microns. In one example, the melamine formaldehyde foam 102 can comprise 0.01 to 45 percent by weight of abrasive particles 104.

Additionally, the cleaning pad 100 can be impregnated with a specially formulated cleaning composition that includes a dilute hydrogen peroxide component in combination with an anionic detergent that includes an anionic surfactant such as sodium lauryl sulfate, which is more fully described in U.S. application Ser. No. 13/836,630, filed Mar. 15, 2013, titled "Surface Cleaning Apparatus", assigned to BISSELL Homecare, Inc., published as US2013/0318725, and which has been previously incorporated by reference in its entirety. The compositions can be impregnated, embedded, encapsulated within, or otherwise affixed to the cleaning pad 100. The cleaning pad 100 can comprise auxiliary flaps 53 as described for the first embodiment. Alternatively, the flaps 53 can simply comprise the ends of the melamine foam 102 portion.

As best shown in FIG. 5, the foot assembly 14 can comprise a steam outlet 26 located on the bottom of the steam frame 22, above the cleaning pad 100 and configured to distribute steam through the backside of the cleaning pad 100, onto the surface to be cleaned.

The steam mop 10, according to the second embodiment of the invention is prepared for use much like the first embodiment and only the differences will be described herein. The steam, or steam/solution mixture, flows through the steam conduit 34 to the steam outlet 26 onto the backside of the cleaning pad 100. The steam, or steam/solution mixture, flows through the cleaning pad 100 onto the surface to be cleaned. As the steam mop 10 is pushed across the surface to be cleaned, the melamine foam 102 and abrasive particles 104 interspersed therein agitate the surface to be cleaned and loosen soil and stuck on debris from the surface to be cleaned in conjunction with the steam, or steam/solution mixture, from the steam outlet 26. The moisture and heat from the steam or steam/solution mixture wets the melamine foam 102 and permits it to optimally remove soils and/or stains from hard surfaces as the cleaning pad 100 is scrubbed on the surface to be cleaned. The elevated temperature of the steam or steam/solution mixture can accelerate and/or improve cleaning performance compared to wetting the foam 102 with a solvent at a lower temperature such as tap water, for example, especially when removing tough, stuck on soils from the surface to be cleaned. Typically, steam mops are provided with absorbent cleaning pads that do not abrade the surface to be cleaned and thus to not provide optimal cleaning performance for removing tough, stuck on soils. However, the cleaning pad 100 disclosed herein containing melamine foam 102 or melamine foam 102 with interspersed abrasive particles 104 is configured to effectively abrade and remove tough, stuck-on soils without damaging the surface to be cleaned. During use, the melamine foam 102 eventually abrades and disintegrates. Accordingly, the soiled cleaning pad 100 can be removed from the foot assembly 14 after the cleaning operation by removing the flaps 53 from the sheet retainers 52. The cleaning pad 100 can then be disposed of accordingly.

Figure 6:
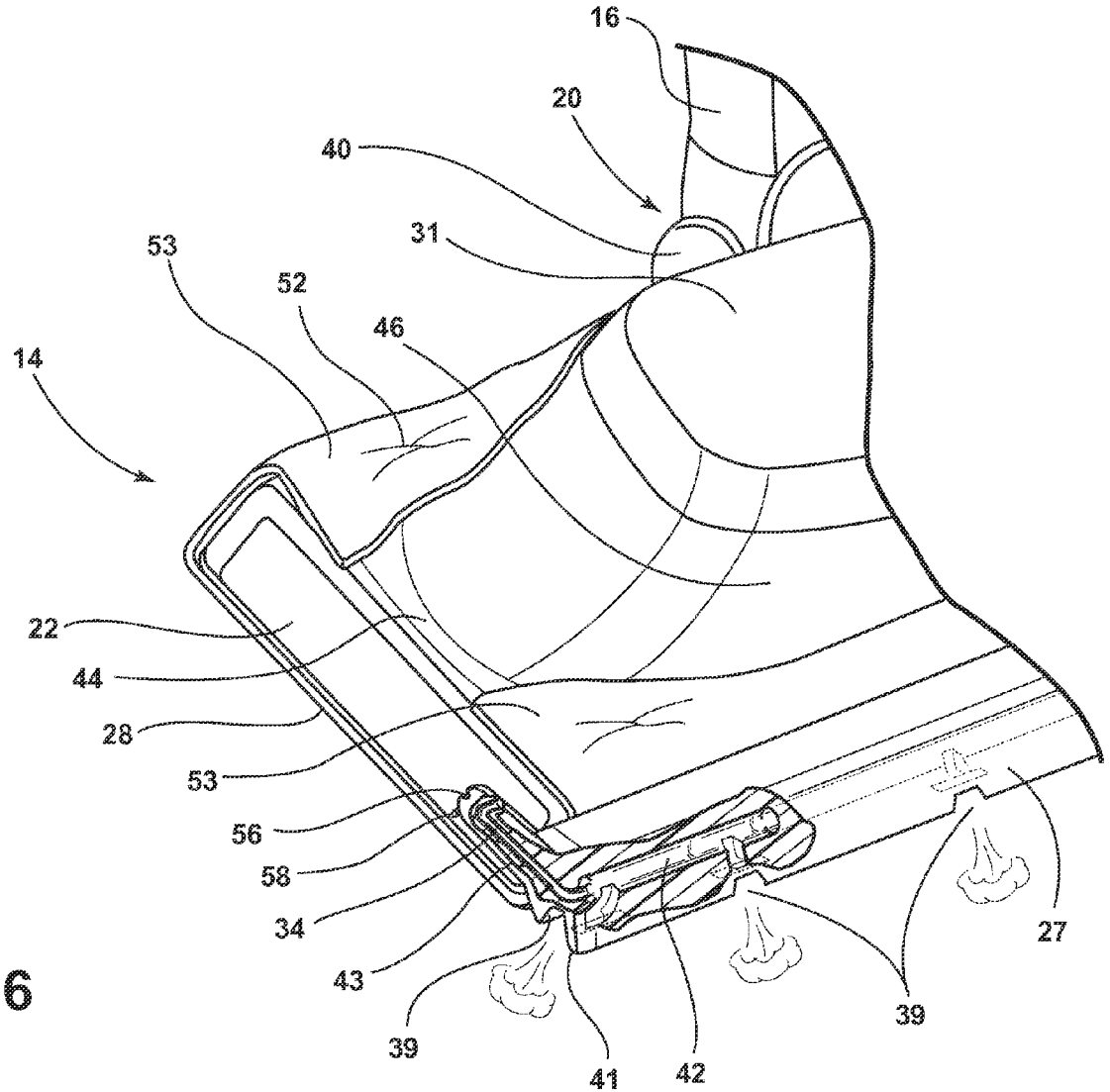
FIG. 6 is a partial perspective view of a foot assembly of a steam mop according to a third embodiment of the invention, with a movable steam manifold in a down position.
Figure 7:
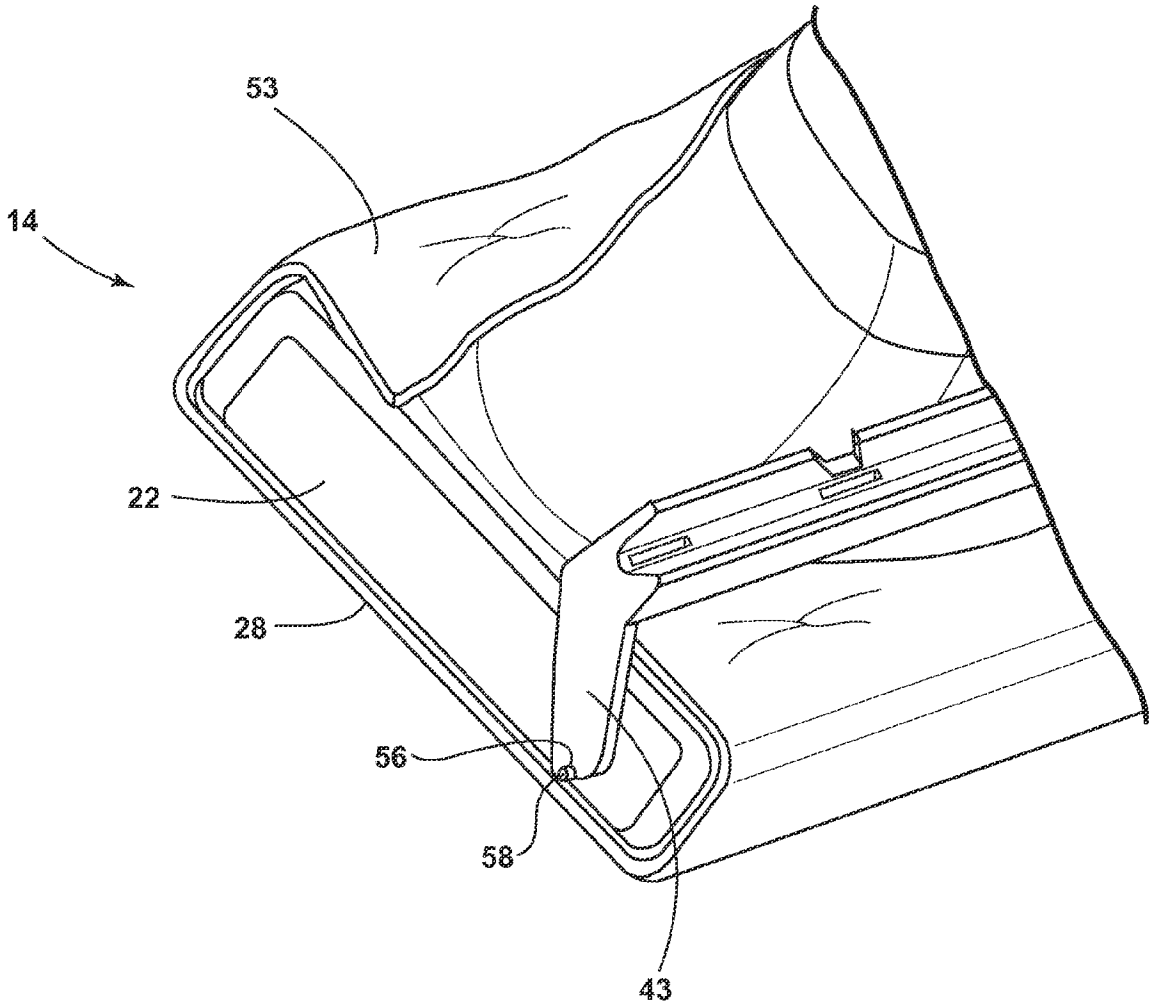
FIG. 7 is a partial perspective view of the foot assembly of the steam mop of FIG. 6, with the movable steam manifold in an up position.

FIGS. 6-7 are partial perspective views of a foot assembly 14 of a steam mop 10 according to a third embodiment of the invention. In the third embodiment, like elements are referred to with the same reference numerals used in the first embodiment. In the third embodiment, the steam conduit 34 that fluidly connects the steam generator 24 to the steam outlet 26 can extend through one of the arms 43 that pivotally mount the steam distribution manifold 27 to the steam frame 22. The conduit 34 can be flexible to accommodate the movement of the manifold 27 between the up and down positions. The conduit 34 can connect with one end of the elongate channel 42 formed within the manifold 27.

Also, a detent 56 is provided on at least one of the arms 43 to retain the distribution manifold 27 in either of the up or down positions. As shown herein, the detent 56 can be configured to retain the distribution manifold 27 in the up position. The detent 56 can be received by a protrusion 58 located on the steam frame 22.

While the invention has been specifically described in connection with certain specific embodiments thereof, it is to be understood that this is by way of illustration and not of limitation, and the scope of the appended claims should be construed as broadly as the prior art will permit. For example, in addition to distributing steam through a manifold along the leading edge of the foot assembly 14, one or more additional steam outlets can be located on the steam frame 22, above the cleaning pad 28 for distributing steam therethrough.

What is claimed is:

1. A surface cleaning apparatus comprising:

a foot movable along a surface to be cleaned and comprising a frame;

a handle coupled to the foot for maneuvering the foot along the surface to be cleaned;

a cleaning pad adjacent to a lower surface of the foot and positioned to contact the surface to be cleaned;

a steam generator provided on one of the foot or the handle for producing steam; and a steam distribution manifold pivotally mounted to the frame along a front of the foot and comprising at least one steam outlet in fluid communication with the steam generator to deliver steam to the surface to be cleaned;

wherein the steam distribution manifold is movable about the frame between a first position for applying steam to the surface to be cleaned and a second position in which the steam distribution manifold is raised with respect to the first position; and wherein the frame is configured to remain on the surface to be cleaned when the steam distribution manifold is in the first and second positions.

2. The surface cleaning apparatus according to claim 1, wherein the cleaning pad is positioned rearwardly of the steam distribution manifold, such that the cleaning pad does not cover the at least one steam outlet.

3. The surface cleaning apparatus according to claim 1, and further comprising a cleaning solution reservoir in fluid communication with the steam generator.

4. The surface cleaning apparatus according to claim 3, and further comprising an auxiliary solution reservoir in fluid communication with the at least one steam outlet, downstream of the steam generator.

5. The surface cleaning apparatus according to claim 1, wherein the steam distribution manifold comprises a hollow member with a plurality of apertures defining the at least one steam outlet.

6. The surface cleaning apparatus according to claim 5, wherein the hollow member defines an elongate channel fluidly connecting the steam generator to the plurality of apertures.

7. The surface cleaning apparatus according to claim 1, wherein the steam distribution manifold comprises a pair of arms pivotally mounted to the foot.

8. The surface cleaning apparatus according to claim 7, wherein the arms comprise detents for retaining the steam distribution manifold in at least one of the first position or the second position.

9. The surface cleaning apparatus according to claim 7, and further comprising a conduit in fluid communication between the steam generator and the at least one steam outlet, wherein the conduit extends through one of the pair of arms.

10. The surface cleaning apparatus according to claim 1, and further comprising a conduit in fluid communication between the steam generator and the at least one steam outlet for conveying steam generated by the steam generator through the steam distribution manifold and onto the surface to be cleaned.

11. The surface cleaning apparatus according to claim 1, wherein the cleaning pad comprises a superabsorbent polymer.

12. The surface cleaning apparatus according to claim 11, wherein the superabsorbent polymer comprises at least one of hydrophilic cellulosic fibers or hydrogel-forming particles.

13. The surface cleaning apparatus according to claim 11, wherein the cleaning pad further comprises a top sheet of non-woven material and a bottom sheet of non-woven material, with the superabsorbent polymer between the top and bottom sheets.

14. The surface cleaning apparatus according to claim 13, wherein the top and bottom sheets are bonded together around the superabsorbent polymer to form flaps at the ends of cleaning pad, wherein the flaps can be used to secure the cleaning pad to the foot.

15. The surface cleaning apparatus of claim 1, wherein the steam distribution manifold is pivotally mounted to the foot for movement about the foot between the first and second positions.

16. The surface cleaning apparatus of claim 1, wherein the cleaning pad is coupled with the frame, and wherein the cleaning pad is positioned to contact the surface to be cleaned when the steam distribution manifold is in the first and second positions.

* * * * *